US005150700A

United States Patent [19]

Troncoso

[11] Patent Number: 5,150,700

[45] Date of Patent: Sep. 29, 1992

[54] ARCHERY BOW ASSEMBLY

[75] Inventor: Vincent F. Troncoso, Montrose, Colo.

[73] Assignee: Golden Key Futura, Inc., Montrose, Colo.

[21] Appl. No.: 744,270

[22] Filed: Aug. 13, 1991

[51] Int. Cl.[5] ..... F41B 5/00

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 2,975,780 | 3/1961 | Fisher | 124/24.1 |
| 3,504,659 | 4/1970 | Babington | 124/24.1 |
| 4,287,868 | 9/1981 | Schiff | 124/44.5 |
| 4,579,101 | 4/1986 | Bateman | 124/44.5 |
| 4,907,566 | 3/1990 | Klein | 124/44.5 |
| 4,953,521 | 9/1990 | Troncoso et al. | 124/24.1 |

*Primary Examiner*—Randolph A. Reese
*Assistant Examiner*—John A. Ricci
*Attorney, Agent, or Firm*—Donald E. Nist

[57] ABSTRACT

The archery bow assembly includes an archery bow with arrow window defined by a generally vertical sidewall and generally horizontal shelf, in which window an arrow rest is adjustably held by a transverse plunger passing laterally through the bow sidewall. An archery arrow is on the rest. The plunger includes an elongated tube with central cavity extending therethrough, and a rod, one end of which is releasably connected to the arrow rest and other end thereof extending into the cavity. One end of the housing extends away from the sidewall on the side opposite the window and terminates in an expanded head having a dish-shaped recess therein. A ball or other weight is seated in and extends out of the recess and is tethered to the rod in the cavity. A spring between the rod and ball in the cavity biases the rest away from the sidewall in the window. When the arrow is fired from the bow, the bow's vibrations rotate the ball forwardly out of the recess, thus pulling the rod and rest toward the sidewall, thereby providing improved clearance for the arrow as it flies through the window. The spring returns the ball, rod and rest to the resting position when the vibrations cease.

6 Claims, 2 Drawing Sheets

ARCHERY BOW ASSEMBLY

BACKGROUND OF THE INVENTION

1. Field of the Invention

The present invention generally relates to sports equipment and more particularly to an improved archery bow assembly employing an automatically disappearing arrow rest.

2. Prior Art

The sport of archery has undergone substantial changes in equipment in recent years. Improved technology has permitted the use of space age materials such as carbon fiber cloth, graphite fiber cloth, advanced plastic sheeting materials and the like. One of the major advances has been in the archery arrows. Up until a few years ago, most target archery arrows have been made of high tensile strength aluminum alloys. Carbon cloth arrows began to supplant aluminum arrows because of the lighter weight and bend resistance of the carbon cloth arrows, which resulted in faster arrow speeds and flatter arrow trajectories, effectively increasing the target area and improving target scores. Carbon cloth arrows, however, were very expensive and easily damaged.

The newest archery arrow technology employs arrows using thin hollow aluminum cores overlaid with carbon cloth ,thus combining the strength and damage resistance of aluminum arrows with the lighter weight ,faster arrow speed and improved accuracy of carbon cloth arrows. Such arrows are of much smaller diameter than conventional all-aluminum arrows and bend less ( archer's paradox) when shot from an archery bow. Therefore, they present a problem of how to clear the arrow rest in the bow window without striking the rest and thereby losing speed and accuracy.

Disappearing rests have been used as a means of providing the necessary arrow clearance. One such rest employs a magnet to hold a thin wire ,upon which the arrow rests, in place. When the wire is struck by the arrow as it is shot, the wire pivots out of the way. This is not satisfactory because of the great arrow speed, which results in some arrow damage and some deviation from the desired arrow flight path due to the strike.

A substantial advance in the disappearing arrow rest art is shown in U.S. Pat. No. 4,953,521. Thus, that patent shows a rest which has a pendulum which must be reset or cocked after each shot. When an arrow is shot from a bow in which the rest is installed and cocked, the bow vibrations during shooting cause the pendulum to move forward to the uncocked position, allowing a spring to instantly draw the arrow rest toward the sidewall of the bow defining the arrow window and thus out of the flight path of the arrow.

Unfortunately, this rest is expensive to make and requires, as indicated above, resetting for each shot. When the rest is used for hunting this can be a distinct disadvantage, since it may be necessary to fire several arrows rapidly at a target to assure a kill. Moreover, in the heat of competition in target archery, the recocking procedure is a nuisance and serves to distract the archer from the concentration necessary for optimum results.

Accordingly, there is a need for an improved arrow rest which will permit proper clearance for an archery arrow passing through the bow window and will not involve recocking for reuse. Such rest should be inexpensive, durable, simple and efficient and equally useful for hunting and for target archery.

SUMMARY OF THE INVENTION

The improved archery bow assembly of the present invention satisfies all the foregoing needs. The assembly is substantially as set forth in the Abstract of the Disclosure.

The assembly includes an archery bow having a pair of spaced limbs interconnected by a bowstring and by a handle riser. The riser has a vertical sidewall and lower horizontal shelf defining an arrow window in which is disposed a disappearing arrow rest of an improved type. The rest comprises a generally horizontal arm upon which an archery arrow rests.

The rest is held in place in the arrow window by a transverse plunger extending through the bow sidewall above the shelf to the window on one end and away from the sidewall on its opposite end. The plunger is an elongated cylindrical housing with a central cavity extending therethrough and with an expanded head on the end thereof away from the window. The head has a dish-shaped recess in its outer end.

A transeverse rod is connected to the side of the arrow rest above the rest arm and extends into the cavity. A spring is trapped between the rod and head and biases the rest out into the window away from the sidewall. A ball or other weight is seated in and extends out of the recess and is tethered to the rod in the cavity.

When an arrow is fired from the bow while on the rest, the bow's vibrations rotate the ball forwardly out of the recess, thus pulling the rod and rest toward the sidewall, thereby providing the necessary clearance for the arrow as it flies through the window. The spring automatically returns the ball, rod and rest to the resting position when the vibrations cease. Thus, no cocking and recocking of the device is needed, either before or after any shot. The rest is always in its proper position before, during and after firing arrows from the bow.

Further features of the improved assembly of the present invention are set forth in the following detailed description and accompanying drawings.

DRAWINGS

DETAILED DESCRIPTION

FIGS. 1-6 and 9

Figure 1:
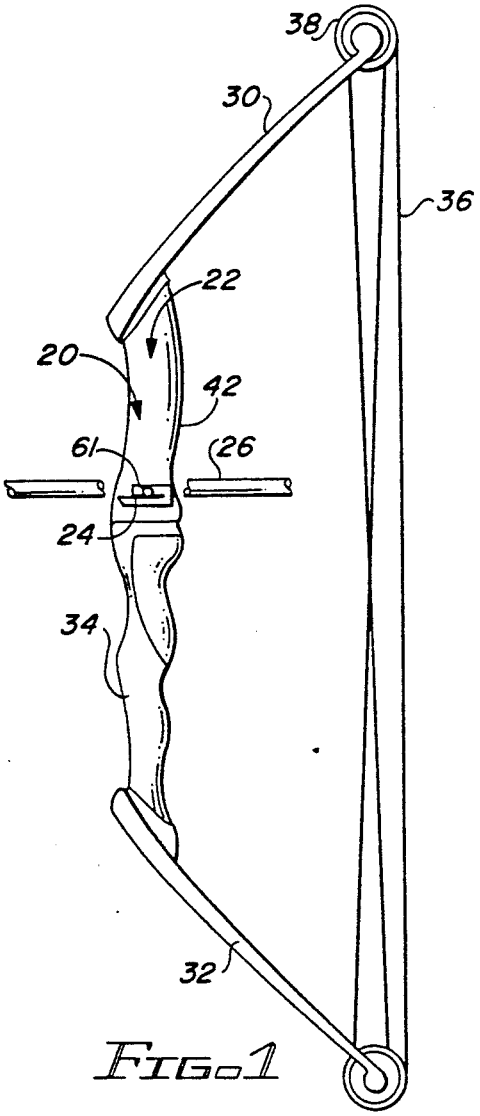
FIG. 1 is a schematic side elevation, partly broken away, of a first preferred embodiment of the improved archery bow assembly of the present invention.
Figure 2:
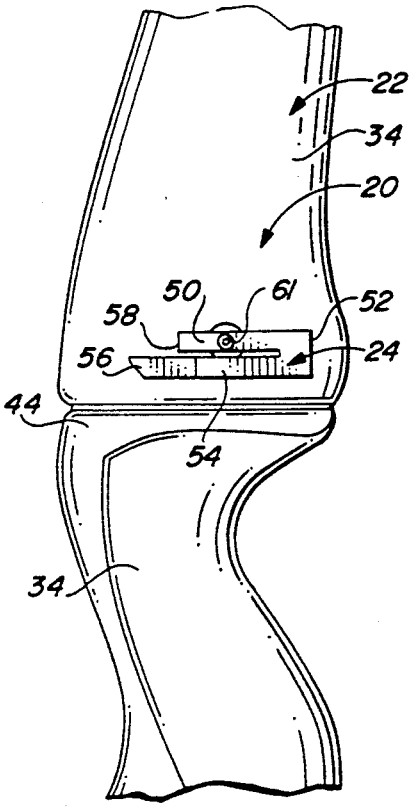
FIG. 2 is an enlarged schematic side elevation of the handle riser portion of the bow of FIG. 1.
Figure 9:
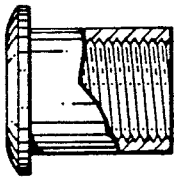
Figure 3:
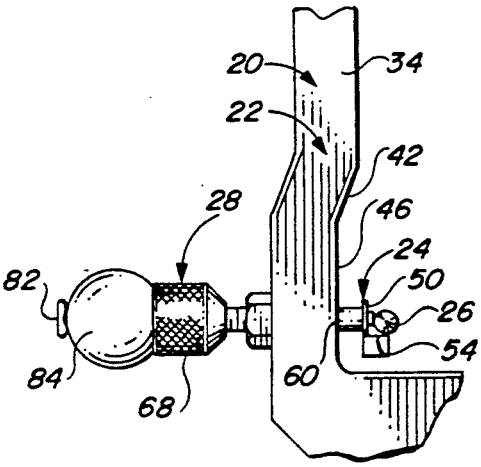
FIG. 3 is an enlarged schematic front elevation of the handle riser portion of the bow of FIG. 1.

Now referring to FIGS. 1-6 and 9 of the drawings, a first preferred embodiment of the improved archery bow assembly of the present invention is schematically depicted therein. Thus, assembly 20 is shown, which comprises an archery bow 22, an arrow rest 24, an arrow 26 on rest 24 and a plunger array 28.

Bow 22 includes a pair of spaced limbs 30 and 32 interconnected by a handle riser section 34 and also by a bowstring 36 trained around wheels 38 and 40 disposed in limbs 30 and 32, respectively. Bow 22 has a vertical sidewall 42 and lower horizontal shelf 44 in riser 34 defining an arrow window 46.

Rest 24 is disposed in window 46 away from sidewall 42, being adjustably held in place by a plunger 48 which is part of array 28. Rest 24 comprises an upper thin horizontal blade 50 interconnected at its rear end 52 to a lower thin horizontal blade 54. The forward portion 56 of blade 54 angles forwardly and outwardly from sidewall 42 and the front portion 58 of blade 52 so as to provide a shelf for the support of arrow 26.

Rest 24 is releasably connected to a transverse rod 60 by a nut 61 extending through the side of blade 50. Rod 60 passes into a central passageway or cavity 62 extending the length of hollow tubular plunger 48. Plunger 48 passes transversely all the way through sidewall 42 so that one end 64 of plunger 48 communicates with window 46 while the other end 66 thereof terminates away from sidewall 42 on the side of bow 22 opposite window 46. End 66 terminates in an expanded head 68 the free end of which has a dish-shaped cavity 70 therein.

Figure 6:
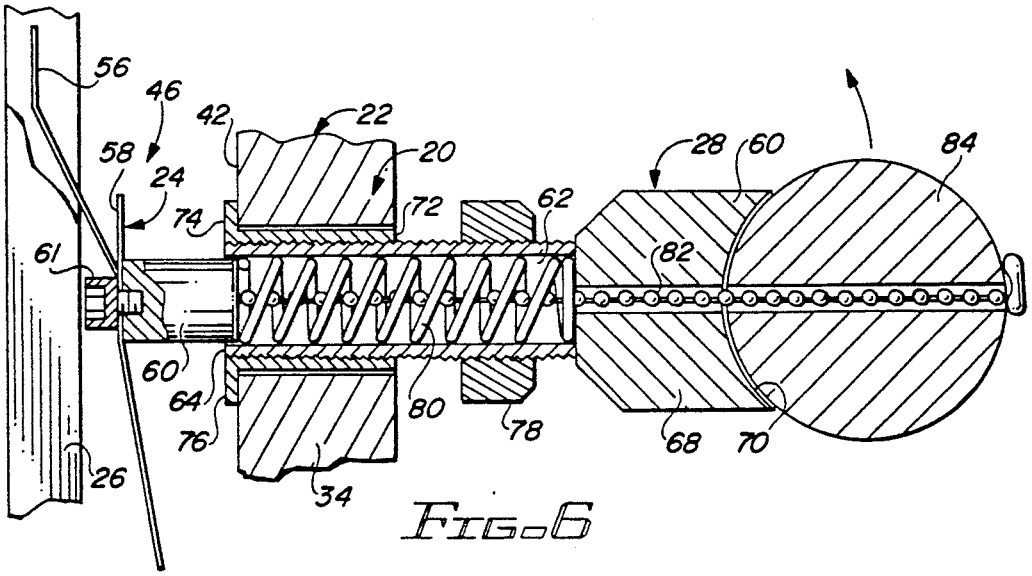
FIG. 6 is an enlarged schematic fragmentary top plan view, partly broken away and partly in section, of the arrow, rest and plunger portions of the assembly of FIG. 1.

In fitting plunger 48 to bow 22, a transverse hole 72 is first drilled through riser 34 into which an internally threaded sleeve 74 with expanded head 76 is force fitted or glued in place. Plunger 48 is externally threaded, except for head 68, and is threaded into place in sleeve 74, as shown in FIG. 6, and releasably locked in position with lock nut 78. Cavity 62 in head 68 is of small diameter. Cavity 62 in the remainder of plunger 48 is sufficiently large to slideably accept rod 60 and a coiled spring 80 trapped between head 68 and rod 60 (FIG. 6). A small chain 82 tethers a round heavy ball 84 seated in recess 70 to rod 60, passing through cavity 62.

Figure 4:
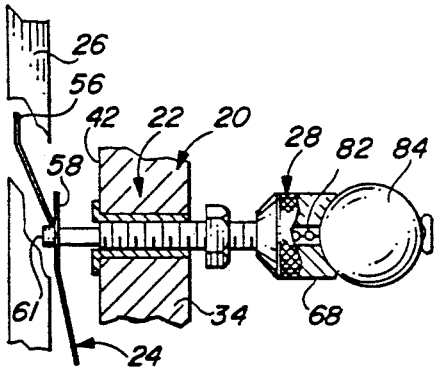
FIG. 4 is an enlarged schematic fragmentary top plan view, partly broken away, of the arrow, rest and plunger portions of the assembly of FIG. 1, shown with the rest in the resting position.
Figure 5:
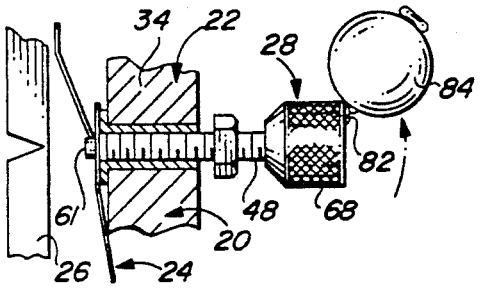
FIG. 5 is an enlarged schematic fragmentary top plan view, partly broken away, of the arrow, rest and plunger portions of the assembly of FIG. 1, shown with the rest in the retracted position.

In the resting position, as shown in FIGS. 4 and 6, spring 80 biases ball 84 into recess 70 and rest 24 out into window 46 away from sidewall 42. In that position rest 24 supports arrow 26 in window 46. However, when arrow 26 on bowstring 36 is shot from bow 22 through window 46, at the moment of release of arrow 26 strong vibrations are set up in bow 22, including riser 34, causing ball 84 to pivot and rotate forward out of recess 70, as shown in FIG. 5, pulling rest 24 toward sidewall 42 and providing total clearance for the passage of arrow 26 through window 46 for unimpeded accurate shooting without damage to arrow 26 or bow 22. Once arrow 26 clears bow 22, vibrations in bow 22 cease and spring 80 automatically returns ball 84 to recess 70 and rest 24 to the resting position shown in FIGS. 4 and 6, ready to accept another arrow for shooting. Thus, rest 24 does not need to be manually cocked or reset. The resetting is automatic, so that shooting of another arrow 26 can quickly ensue for optimal hunting and target shooting.

Rest 24 is preferably made of thin steel or other metal and blade 54 thereof may have some resiliency so as to absorb vertical pressure encountered through arrow 26 during shooting. Side pressure from arrow 26 during shooting is absorbed by spring 80 through nut 78, which encounters the side of arrow 26, and rod 60 connected to nut 78 and bearing against spring 80. Rod 60, nut 78 and plunger body 48 may be of brass, steel, etc., as may spring 80. It will be understood that rod 60, nut 78 and spring 80 can be considered as part of plunger 48. Bow 22 and arrow 26 can be of any conventional materials, including high technology materials such as carbon cloth laminates, etc.

Thus, assembly 20 has improved properties , rest 24 acting as a true disappearing rest without having to reset it or recock it between shots from bow 22.

FIG. 7

Figure 7:
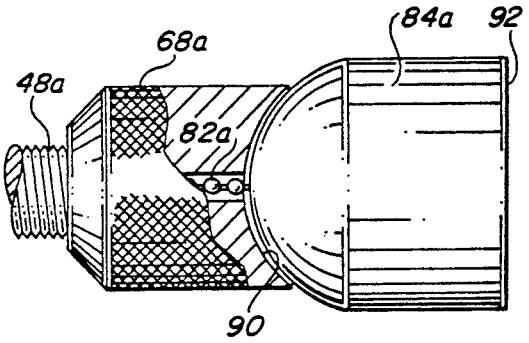
FIG. 7 is an enlarged schematic fragmentary rear elevation, partly broken away, of a second preferred embodiment of the plunger portion of the assembly of the present invention.

A second preferred embodiment of the head and ball portions of the plunger of the present invention is depicted schematically in FIG. 7. Thus, plunger **48*a* is shown which is in all respects, except those pointed out below, the same as plunger 48 and can be substituted therefor in assembly 20. Plunger 48*a* differs from plunger 48 only in the shape of ball 84*a* which instead of being round has a curved inner end 90 and flat opposite end 92. Plunger 48*a* functions similarly to plunger 48**.

FIG. 8

Figure 8:
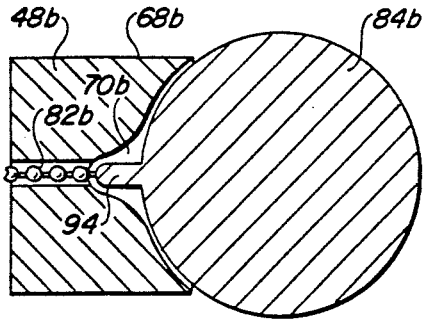
FIG. 8 is an enlarged schematic fragmentary vertical cross-section of a third preferred embodiment of the plunger portion of the assembly of the present invention; and, FIG. 9 is an enlarged schematic top plan view, partly broken away, of a sleeve utilized in the plunger of FIG. 4.

A third preferred embodiment of the head and ball portions of the plunger of the present invention is set forth in FIG. 8. Plunger **48*b* is depicted which differs from plunger 48 only in minor respects and not at all in function. Ball 84*b* is round, but has a nipple 94 to which is connected the end of chain 82*b*, rather than having chain 82*b* run all the way through ball 84*b* as chain 82 does through ball 84. Recess 70*b* may also be of slightly different configuration from recess 70. Plunger 48*b* can be substituted for plunger 48 in assembly 20**.

Various other modifications, changes, alterations and additions can be made in the improved archery bow assembly of the present invention, its components and their parameters. All such modifications, changes, alterations and additions as are within the scope of the appended claims form part of the present invention.

What is claimed is:

1. An improved archery bow assembly comprising, in combination:

a) an archery bow comprising a pair of spaced limbs interconnected by a bowstring and by a handle riser having an about vertical sidewall and an about horizontal shelf defining an arrow window; and, b) an archery arrow rest having an archery arrow releasably disposed thereon, said rest being disposed in said window by a transverse plunger extending through said sidewall above said shelf, said plunger including i. an elongated tubular housing having a central cavity extending therethrough and having an expanded head on the side of said bow away from said window, said head having a generally dish-shaped recess on the free end thereof, i.i. a transverse rod releasably connected to said arrow rest and passing into said cavity, i.i.i. a spring trapped in said cavity between said rod and said head and biasing said rod and rest towards said window, i.i.i.i. an enlarged weight with a curved surface seated in said recess, said weight projecting laterally of said head, and v. tether means in said cavity interconnecting said rod and weight, whereby said rest, rod and weight are biased by said spring into a resting position with said rest away from said sidewall in said window, said weight during shooting of said arrow from said bowstring being activated by the resultant bow vibration to move forward ,rotating out of said recess, thus drawing along with it said rest and rod toward said sidewall against said spring bias, for improved clearance of said arrow during its flight through said window, said weight, rod and rest thereafter returning to said resting position , due to said spring bias.

2. The improved archery bow assembly of claim 1 wherein said rest comprises a generally horizontal arm upon which the bottom of said arrow rests, with a side of said arrow against said rod.

3. The improved archery bow assembly of claim 1 wherein said weight is a ball and said tether is a chain.

4. The improved archery bow assembly of claim 1 wherein said spring is positioned in said cavity around said tether with one end of said spring held in said head.

5. The improved archery bow assembly of claim 1 wherein said weight has a protrusion in said recess to which said tether is connected.

6. The improved archery bow assembly of claim 1 wherein said weight is non-spheroidal, wherein said rod extends through the side of said rest to directly contact the side of said arrow, wherein said rest is resilient and wherein said housing is threaded into a fitting in the sidewall of said handle riser, for lateral adjustment in order to adjustably position said rest in said window.

* * * * *